US005401143A

United States Patent [19]

Yu

[11] Patent Number: 5,401,143

[45] Date of Patent: Mar. 28, 1995

[54] MULTI-STAGE AUTOMOTIVE FUEL PUMP HAVING ANGELED FUEL TRANSFER PASSAGE

[75] Inventor: Dequan Yu, Ann Arbor, Mich.

[73] Assignee: Ford Motor Company, Dearborn, Mich.

[21] Appl. No.: 72,024

[22] Filed: Jun. 7, 1993

[51] Int. Cl.[6] ..... F04B 23/08; F04B 23/12

[52] U.S. Cl. ..... 417/203; 417/205; 417/366; 415/55.6

[58] Field of Search ..... 417/201, 203, 205, 357, 417/366; 415/55.6

[56] References Cited

U.S. PATENT DOCUMENTS

| | | | |
|---|---|---|---|
| 3,657,971 | 4/1972 | Freeman | 417/203 |
| 3,874,812 | 4/1980 | Hanagarth . | |
| 4,209,284 | 6/1980 | Lochmann et al. | 415/55.6 |
| 4,219,917 | 9/1980 | Bearden et al. . | |
| 4,336,002 | 6/1982 | Rose et al. | 417/203 |
| 5,129,796 | 7/1992 | Emmert et al. | 415/55.6 |

FOREIGN PATENT DOCUMENTS

| | | | |
|---|---|---|---|
| 2165390 | 7/1972 | Germany | 415/55.6 |
| 2460518 | 7/1975 | Germany | 415/55.6 |
| 2745792 | 4/1979 | Germany | 417/203 |
| 228365 | 2/1925 | United Kingdom . | |
| 1145283 | 3/1969 | United Kingdom . | |
| 2036869 | 7/1980 | United Kingdom . | |
| 2134598 | 8/1984 | United Kingdom | 415/55.6 |
| 2203490 | 10/1988 | United Kingdom . | |
| 2263503 | 7/1993 | United Kingdom . | |

*Primary Examiner*—Richard E. Gluck
*Assistant Examiner*—Roland G. McAndrews, Jr.
*Attorney, Agent, or Firm*—Jerome R. Drouillard; Roger L. May

[57] ABSTRACT

A multi-stage automotive fuel pump includes a casing and motor located within the casing for driving primary and secondary pumping sections, with the primary and secondary pumping sections sharing a common wall which axially separates primary and secondary rotary pumping elements and which houses a fuel transfer for moving fuel from the primary into the secondary pumping sections in a manner which avoids generation of turbulence and cavitation.

9 Claims, 2 Drawing Sheets

MULTI-STAGE AUTOMOTIVE FUEL PUMP HAVING ANGELED FUEL TRANSFER PASSAGE

BACKGROUND OF THE INVENTION

The present invention relates to a multi-stage automotive fuel pump which is intended to provide gasoline or other light hydrocarbon fuels to fuel injectors of a spark-ignited internal combustion engine.

DESCRIPTION OF THE PRIOR ART

Although multi-stage fuel pumps are shown in the prior art, such pumps generally have a transfer port running between the stages at a 90° angle measured from the faces of the pumping elements, as illustrated in FIG. 4. As shown in FIG. 4., the angle $\theta$ at 90° presents a problem which is illustrated in FIG. 4A. The flow through a regenerative turbine type pump flow channel is generally one which is doubly rotational. Thus, the flow not only occurs around the circumference of the pumping channel in the direction in which the turbine rotates, but also the flow occurs toroidally in the pumping channel itself. This toroidal flow presents a problem when its direction must be suddenly changed because the sudden change of direction may cause a loss of fluid energy. This loss is exacerbated if the flow path is as shown in FIG. 4A, where the flow vector must move through a sharp 90° turn in order to be discharged from the primary outlet on its path to the secondary pumping element. The pump according to the present invention obviates this problem in the manner explained herein.

SUMMARY OF THE INVENTION

A multi-stage automotive fuel pump comprises a casing, a motor contained within the casing and having a driveshaft extending from the motor, a primary pumping section powered by the motor with the primary pumping section having a primary rotary pumping element attached to the driveshaft and contained within a primary pump housing position with the casing, and a secondary pumping section powered by the motor with the secondary pumping section having secondary rotary element attached to the driveshaft and contained within a secondary pump housing positioned within the casing. A pump according to the present invention further includes fuel transfer means for accepting pumped fuel from the primary pumping section and for transmitting the pumped fuel to the secondary pumping section. The fuel transfer means comprises a fuel transfer passage extending between the primary pump housing and the secondary pump housing, with the fuel transfer passage having an outlet for the primary pumping section and an inlet for the secondary pumping section, and a center channel extending between the inlet and outlet at an included angle which is generally acute with the faces of the rotary pumping elements. The primary and secondary pump housings preferably share a common wall which axially separates the primary secondary rotary pumping elements. The fuel transfer passage is preferably formed in the common wall.

The rotary pumping elements each comprise generally planar disks with each having two parallel faces and with the center channel of the fuel transfer passage extending at an included angle of 25°–30° with the faces of the rotary pumping elements. The rotary pumping elements may comprise either a pair of regenerative turbine elements or, alternatively, a regenerative turbine and a gerotor element. If a gerotor element and regenerative turbine are used, the outside diameter of the regenerative turbine will generally be greater than the outside diameter of the gerotor pump, with the result that the center channel of the fuel transfer passage will extend radially inwardly from the outlet of the primary pumping section to the inlet of the secondary pumping section. The primary and secondary pump housings of a pump according to the present invention preferably comprise a lower pump housing, an upper pump housing, and a center housing, with the lower and center housings defining a pumping chamber for enclosing a regenerative turbine element, and with the upper and center housings defining a pumping chamber for a gerotor pumping element, and with the fuel transfer means being located within the center housing. The center housing preferably comprises a disk-shaped body with two parallel faces, with one of the faces having a cup-shaped opening for receiving a regenerative turbine element and with the other of the faces being generally flat.

DETAILED DESCRIPTION OF THE PREFERRED EMBODIMENT

Figure 1:
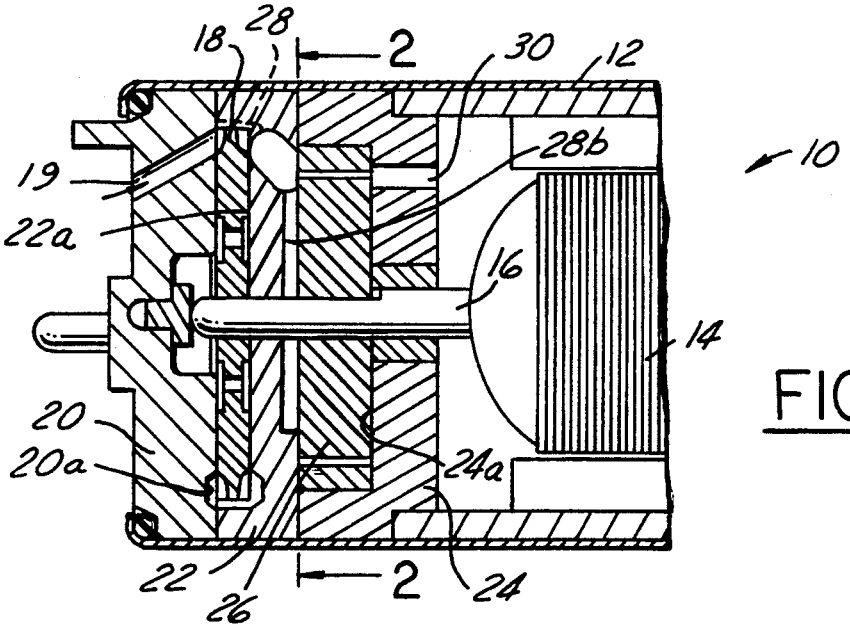
FIG. 1 is a multi-stage pump according to the present invention having both a regenerative turbine pumping element and a gerotor pumping element.

As shown in FIG. 1, a multi-stage automotive fuel pump includes a casing 12 having a motor and pumping elements installed therein. Accordingly, motor 14 contained within casing 12 has a driveshaft 16 extending from the motor such that the motor powers the two rotary pumping elements. Primary rotary pumping element 18 comprises a regenerative turbine which is attached to and which rotates with driveshaft 16. Rotary pumping element 18 comprises a portion of a primary pumping section, with the remainder of the pumping section comprising primary intake 19 which picks up fuel from the liquid surrounding the pump within the vehicle's fuel tank or, if pump 10 is externally mounted, from a line extending into the fuel tank. The primary pumping section further includes a primary pump housing, which is defined by lower pump housing 20 and by center housing 22, which comprises a generally disk-shaped body with two parallel faces, and which has a cup-shaped opening 22a into which primary rotary pumping element 18 is inserted. Center housing 22 also has annular pumping channel 22b formed therein (FIG. 6), which corresponds to an annular pumping channel 20a formed in the opposing face of lower pump housing 20.

The second rotary pumping element of a pump according to the present invention in this case comprises a gerotor element 26 which is nestled in a cup-shaped space 24a formed in upper pump housing 24. The secondary pumping section of the present pump is of course powered by motor 14 by means of driveshaft 16. As before, the secondary pumping section includes a pump housing and pumping element. Upper pump housing 24 and center housing 22 define a secondary pump housing for gerotor secondary rotary pumping element 26.

Fuel passing through pump 10 of FIG. 1 enters primary intake 19 and is pumped initially by regenerative turbine rotary pumping element 18. Having been pumped by element 18, the fuel is further pumped by gerotor secondary rotary pumping element 26. In a pump according to the present invention, a high level efficiency is maintained because the transfer of fuel between primary rotary pumping element 18 and secondary rotary pumping element 26 is managed efficiently and smoothly with minimized turbulence and cavitation. Of course, as with most rotary machines, seemingly insignificant losses in efficiency for various sections of the pump will greatly impair the overall efficiency of the device. In this case, fuel transfer passage 28 (see FIG. 1), which extends through the common wall portion of center housing 22, smoothly guides the fluid mainstream from the tangential direction to the axial direction and minimizes, as noted above, turbulence and cavitation.

Figure 2:
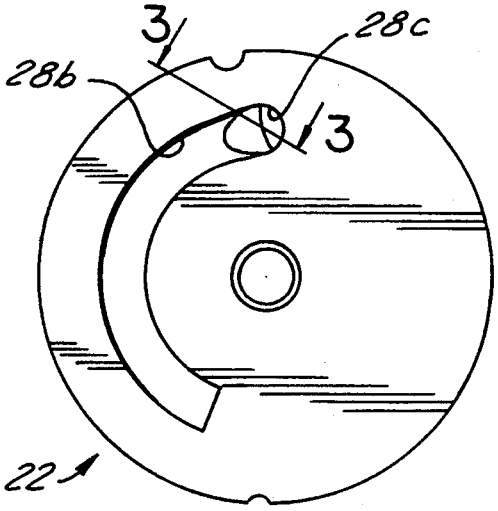
FIG. 2 is a plan view of the center pump housing of the pump of FIG. 1 taken in the direction 2—2 of FIG. 1.
Figure 3:
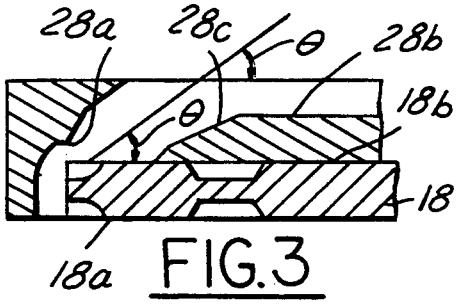
FIG. 3 illustrates the fuel transfer passage of the pump of FIGS. 1 and 2 taken along the line 3—3 of FIG. 2.
Figure 6:
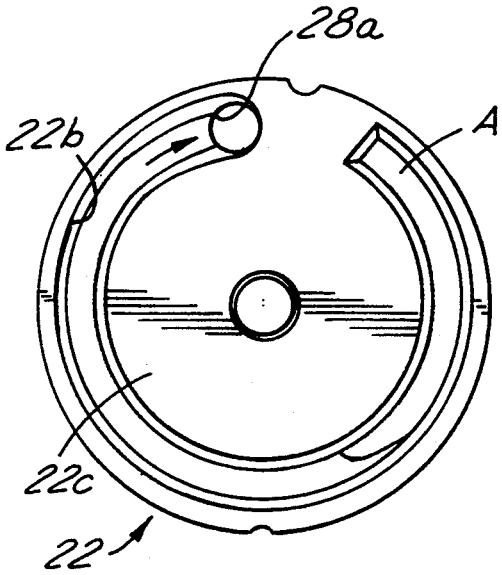
FIG. 6 illustrates the center housing of the pump of FIG. 5, taken in the direction of line 6—6 of FIG. 5. The illustration in FIG. 6 also accurately describes the similar view of center housing 22 of FIG. 1 taken in the same direction.

Additional details of fuel transfer passage 28 are shown with reference to FIGS. 2, 3 and 6. Fuel entering primary intake 19 is picked up by primary rotary pumping element 18 and progresses, as shown in FIG. 6, in a clockwise direction beginning at point A. After rotating about the full extent of pumping channel 22b, the fuel leaves the primary pumping section via primary outlet 28a (FIGS. 3 and 6). After entering primary outlet 28a, the fuel ultimately flows into the secondary inlet and pumping channel 28b, which is shown at FIG. 2 for the pump depicted in FIG. 1. Notice that the radius of channel 28b of FIG. 2 is less than that depicted for pumping channel 22b of FIG. 6. This is because the diameter of secondary rotary pumping element 26 is less than that of primary rotary pumping element 18.

Upon entering secondary inlet and pumping channel 28b (FIG. 2), liquid fuel is fed to gerotor pumping element 26 and thereafter exits the secondary pumping section via outlet 30. As shown in FIG. 2, secondary inlet and pumping channel 28b extends around a circular arc segment of approximately 160° in the direction of rotation of the secondary gerotor pumping element.

The transition of fuel from the primary to the secondary rotary pumping element is eased by the construction of center channel 28c of the fuel transfer passage 28. With reference now to FIG. 3, primary rotary pumping element 18 is depicted as having parallel faces 18a and 18b. Fuel pumped by element 18 leaves the primary pumping section by means of primary outlet 28a and flows through center channel 28c and ultimately into secondary inlet and pumping channel 28b. Notice in FIG. 3 that the central chord of center channel 28c makes an acute included angle, $\theta$, with face 18a of rotary pumping element 18 which is 25°–30°. This 25°–30° angle allows the fuel to flow smoothly from the primary to the secondary pumping sections without undue turbulence or cavitation. This flowpath is shown graphically in FIG. 3A. As seen from FIG. 3A, the flow changes from a tangential to a modified axial flow. The transfer of fluid in Applicant's device from the primary to the secondary pumping sections is contrasted with that of the prior art transfer flow shown in FIGS. 4 and 4A. Notice in FIG. 4 that the angle $\theta$ is approximately 90°. As a result, the flow shown in FIG. 4A as leaving the primary pumping section must make approximately a right angle turn and flow purely axially from the primary pumping section to the secondary pumping section. As a result, losses are engendered to the detriment of the pump's performance. The present invention overcomes this problem in the manner shown.

Figure 5:
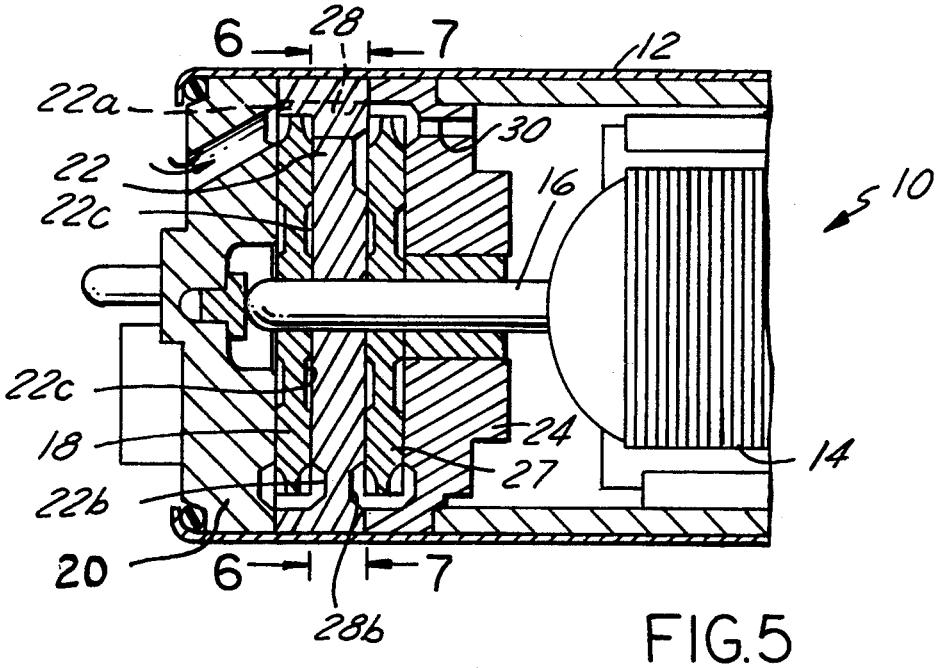
FIG. 5 illustrates a second embodiment of a fuel pump according to the present invention having dual regenerative turbine rotary pumping elements.

FIG. 5 shows a second embodiment according to the present invention in which twin regenerative turbine elements 18 and 27, respectively, are used for the primary and secondary rotary pumping elements. As before, center housing 22 comprises a generally disk-shaped unitary body having two parallel faces and a cup-shaped depression 22a for housing primary rotary pumping element 18. Also as with the embodiment of FIG. 1, lower pump housing 20 and center pump housing 22 define a primary pumping chamber, whereas upper pump housing 24 and center pump housing 22 define a secondary pumping chamber. Fuel entering the pump at inlet 19 is first pumped by primary pumping element 18, and after passing through fuel transfer passage 28 is then pumped by secondary pumping element 27, before being discharged from outlet 30.

Figure 3A:
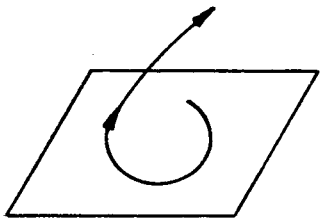
FIG. 3A illustrates the flow vector through the fuel transfer passage of a pump according to the present invention.
Figure 4:
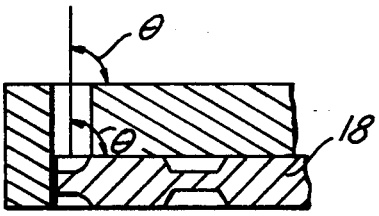
(PRIOR ART) FIG. 4
FIGS. 4 and 4A illustrate the construction and flow through a prior art multi-stage pump.
Figure 4A:
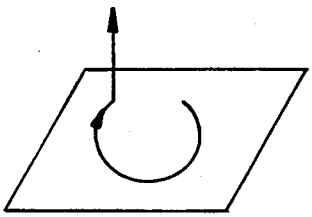
(PRIOR ART) FIG. 4A
Figure 7:
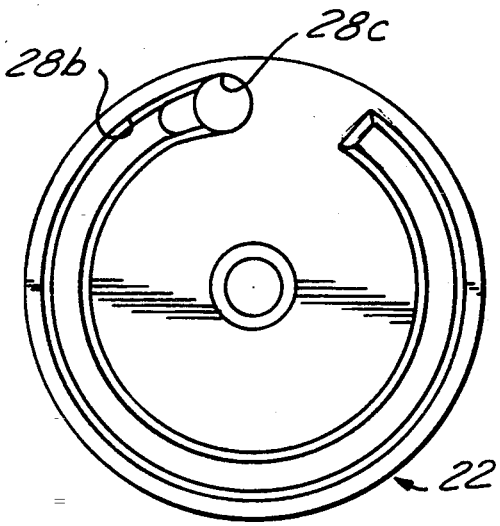
FIG. 7 is a plan view of the face of center housing 22, taken along the line 7—7 of FIG. 5.

As noted previously, FIG. 6 shows the lower side of center housing 22—i.e., that face of center housing 22 which forms a portion of the primary pumping section in conjunction with primary rotary pumping element 18 and lower pump housing 20. Thus, FIG. 6 is equally applicable to both of the embodiments of the present invention. On the other hand, FIG. 7 illustrates the face of center housing 22 which adjoins secondary rotary pumping element 27 of the pump shown in FIG. 5. As shown in FIG. 7, secondary inlet and pumping channel 28b circumscribes almost the entire circumference of center housing 22. The angular measure $\theta$ having a magnitude similar to that shown in FIG. 3 for the center chord of center channel 28c is generally maintained for the pump of FIGS. 5–7, with a preferred value for $\theta$ being an acute included angle of approximately 27° for the embodiment of FIG. 5. As with the embodiment of FIG. 1, center channel 28c does not comprise a purely axial passage but rather contains a component directed about the circumference of the pumping channel such that the desirable flowpath characteristic illustrated in FIG. 3A is maintained as fuel transits from the primary pumping section to the secondary pumping section along fuel transfer passage 28.

It is claimed:

1. A multi-stage automotive fuel pump comprising:

a casing;

a motor contained within said casing and having a driveshaft extending from said motor;

a primary pumping section powered by said motor, with said primary pumping section having a regenerative turbine pumping element attached to said driveshaft and contained within a primary pump housing positioned within said casing, and with said primary pump housing having an primary inlet for admitting fuel into the fuel pump;

a secondary pumping section powered by said motor, with said secondary pumping section having a gerotor pumping element attached to said driveshaft and contained within a secondary pump housing positioned within said casing, with said secondary pump housing having an secondary outlet for discharging pumped fuel from the secondary pumping section; and fuel transfer means for accepting pumped fuel from the primary pumping section and for transmitting the pumped fuel to the secondary pumping section, with said fuel transfer means comprising a fuel transfer passage extending through a common wall positioned between said primary pump housing and said secondary pump housing, with said fuel transfer passage having a primary outlet for said primary pumping section and a secondary inlet which extends around a circular arc segment of approximately 160° in the direction of rotation of said gerotor for said secondary pumping section, and a center channel extending between said inlet and said outlet at an included angle of 25°–30° to the faces of said rotary pumping elements.

2. A fuel pump according to claim 1, wherein said primary and secondary pump housings comprise a lower pump housing, an upper pump housing, and a center housing, with said lower and center housings defining a pumping chamber for enclosing said regenerative turbine pumping element, and with said upper and center housings defining a pumping chamber for enclosing said gerotor pumping element, with said fuel transfer means being located within said center housing.

3. A fuel pump according to claim 2, wherein said center housing comprises a generally disc-shaped, unitary body.

4. A fuel pump according to claim 2, wherein said center housing comprises a generally disc-shaped body with two parallel faces, with one of said faces having a cup-shaped opening for receiving said regenerative turbine pumping element and with the other of said faces being generally flat.

5. A multi-stage automotive fuel pump comprising:

a casing;

a motor contained within said casing and having a driveshaft extending from said motor;

a primary regenerative turbine pumping section powered by said motor, with said primary pumping section having a primary rotary pumping element attached to said driveshaft and contained within a primary pump housing positioned within said casing;

a secondary regenerative turbine pumping section powered by said motor, with said secondary pumping section having a secondary rotary pumping element attached to said driveshaft and contained within a secondary pump housing positioned within said casing; and a fuel transfer means for accepting pumped fuel from the primary pumping section and for transmitting the pumped fuel to the secondary pumping section, with said fuel transfer means comprising a fuel transfer passage extending between said primary pump housing and said secondary pump housing, with said fuel transfer passage having an outlet for said primary pumping section and an inlet for said secondary pumping section and a generally cylindrical center channel extending between said inlet and said outlet at an included angle which is generally acute to the faces of said rotary pumping elements, with said inlet also serving as a pumping channel for the secondary regenerative turbine.

6. A pump according to claim 1, wherein said primary and secondary pump housings share a common wall which axially separates the primary and secondary rotary pumping elements, with said fuel transfer passage being formed in said common wall.

7. A pump according to claim 1, wherein said rotary pumping elements each comprise generally planar discs, with each having two parallel faces, and with said center channel extending at an included angle of 25°–30° to the faces of said rotary pumping elements.

8. A pump according to claim 1, wherein said primary pumping element comprises a regenerative turbine, and said secondary rotary pumping element comprises a gerotor.

9. A pump according to claim 8, wherein the outside diameter of said regenerative turbine is greater than the outside diameter of said gerotor pump, with said center channel extending radially inwardly from said outlet to said inlet.

* * * * *